US010874217B2

(12) United States Patent
Grace

(10) Patent No.: US 10,874,217 B2
(45) Date of Patent: Dec. 29, 2020

(54) COLLAPSIBLE AND PORTABLE ROCKING CHAIR

(71) Applicant: GCI Outdoor, Inc., Higgaum, CT (US)

(72) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 0 days.

(21) Appl. No.: 16/164,117

(22) Filed: Oct. 18, 2018

(65) Prior Publication Data

US 2019/0110599 A1 Apr. 18, 2019

Related U.S. Application Data

(60) Provisional application No. 62/573,969, filed on Oct. 18, 2017.

(51) Int. Cl.
*A47C 3/025* (2006.01)
*A47C 4/28* (2006.01)

(52) U.S. Cl.
CPC ..... *A47C 3/0255* (2013.01); *A47C 4/286* (2013.01)

(58) Field of Classification Search
CPC ..... A47C 4/286; A47C 3/02; A47C 3/0255; A47C 7/44; A47C 7/443
USPC ..... 297/45, 271.5
See application file for complete search history.

(56) References Cited

U.S. PATENT DOCUMENTS 77,117 A 4/1868 Smith
77,161 A 4/1868 Blake
89,827 A 5/1869 Badlam et al.
92,758 A 7/1869 Smith
96,211 A 10/1869 Emerson
(Continued)

FOREIGN PATENT DOCUMENTS

CN 2501389 Y 7/2002
CN 1864594 A 11/2006
(Continued)

OTHER PUBLICATIONS

International Search Report for PCT/US2013/063721 dated Jan. 9, 2014.

(Continued)

*Primary Examiner* — Milton Nelson, Jr.
(74) *Attorney, Agent, or Firm* — Lathrop GPM LLP; Wm. Tucker Griffith

(57) ABSTRACT

A collapsible and portable rocking chair includes left and right frame side assemblies collectively defining forward and rear leg members, armrests, seat support members and back support members. The chair also includes transverse connectors connecting the left and right frame said assemblies and supporting the chair in its set-up condition. The connectors are pivotally connected to one another as well as to the left and right frame side assemblies to facilitate folding of the chair frame to a collapsed and bundled condition where all the frame members are pivoted and/or slid relative to one another to a generally parallel condition. Each frame side assembly is supported on a fulcrum point for rocking movement of the chair frame. A rocker mechanism is attached to the chair frame to support the chair during rocking movement and to facilitate rocking of the chair in connection with the user's shifting weight.

21 Claims, 10 Drawing Sheets

(56) References Cited

U.S. PATENT DOCUMENTS 97,314 A 11/1869 Purington
114,812 A 5/1871 Hartman
117,132 A 7/1871 Winchester
142,145 A 8/1873 Chichester
165,684 A 7/1875 Ober
234,537 A 11/1880 Clough
326,165 A 9/1885 Short
369,806 A 9/1887 Nabal
375,840 A 1/1888 Stockton
376,256 A 1/1888 Parks
451,490 A 5/1891 Kade
470,707 A 3/1892 Saunders
490,366 A 1/1893 Seng
585,422 A 6/1897 Boenning
1,022,858 A 4/1912 Markus
1,138,270 A 3/1914 Ziegler
1,273,939 A 7/1918 Sidel
1,288,716 A 12/1918 Small
1,396,661 A 11/1921 Parr
1,526,920 A 2/1925 Liptak
1,570,096 A 1/1926 Stransky
1,604,108 A 1/1926 Antipas
1,627,388 A 10/1926 Hayes
1,676,074 A * 7/1928 Brown ..... A47C 3/029 248/436
1,767,736 A * 6/1930 Brown ..... A47C 3/029 248/436
1,798,272 A 3/1931 Phillips
1,856,759 A 5/1932 Grondin
1,882,585 A 10/1932 Hayes
1,900,486 A 3/1933 Clarin
1,925,246 A 9/1933 Hayes
1,945,580 A 2/1934 Turnai
1,987,014 A 1/1935 Lampila
2,056,957 A 10/1936 Colbridge
2,125,920 A 8/1938 Homer
2,227,717 A 1/1941 Jones
2,280,732 A 4/1942 Thum
2,403,558 A * 7/1946 Schoof ..... A47C 3/029 297/45
2,543,273 A 2/1951 Beil
2,543,543 A 2/1951 Gomes
2,608,240 A 8/1952 Booth
2,620,859 A 12/1952 Kundtz
2,629,432 A 2/1953 Otto
2,675,057 A 4/1954 Glass
2,741,298 A 4/1956 Roberts, III
2,802,515 A 8/1957 Murray
2,862,710 A 2/1958 Lewis
2,837,142 A 6/1958 McGuire
2,852,883 A 9/1958 Walsh
2,914,111 A 11/1959 Mize
2,930,429 A 3/1960 Mize
3,000,667 A 9/1961 Dryden
3,026,143 A 3/1962 Kundtz
3,039,818 A 6/1962 Frank
3,114,572 A 12/1963 Hopkins
3,225,380 A 12/1965 Faul
3,337,265 A 8/1967 Benzing
3,730,584 A 5/1973 Uchida
3,851,914 A 12/1974 Nii
3,968,991 A 7/1976 MacLaren
4,047,753 A * 9/1977 Uchida ..... A47C 3/029 297/32
4,065,173 A 12/1977 Gittings
4,082,348 A 4/1978 Haury
4,101,143 A 7/1978 Sieber
4,105,244 A 8/1978 Colby
4,118,064 A 10/1978 Robeson
4,119,343 A 10/1978 Pentzien
4,140,341 A 2/1979 Rabe
4,141,530 A 2/1979 Ward
4,183,494 A 1/1980 Cleveland
4,232,897 A 11/1980 MacLaren
4,285,543 A 8/1981 Clark
4,306,638 A 12/1981 Malott
4,340,250 A 7/1982 Ward
4,372,606 A 2/1983 Faull
4,453,732 A 6/1984 Assanah
4,491,335 A 1/1985 Evron
4,579,383 A 4/1986 Colby
4,593,929 A 6/1986 Williams
4,674,795 A 6/1987 Nelson
4,684,149 A 8/1987 Meyer
4,736,984 A 4/1988 Tacker
4,754,987 A 7/1988 Williams
4,772,067 A 9/1988 Fowler
4,786,072 A 11/1988 Girvin
4,809,998 A 3/1989 Girvin
4,826,241 A 5/1989 Barras
4,979,779 A 12/1990 Williams
5,004,259 A 4/1991 Ayers
5,040,846 A 8/1991 Finney
5,058,949 A 10/1991 Von Hoffman
5,076,390 A 12/1991 Haskins
5,188,383 A 2/1993 Thompson
5,328,183 A 7/1994 Counts
5,375,911 A 12/1994 Morrow
5,419,571 A 5/1995 Vaughan
5,490,715 A 2/1996 Opsvik
5,507,548 A 4/1996 Marhefka
5,513,867 A 5/1996 Bloswick
5,560,675 A 10/1996 Altheimer
5,720,473 A 2/1998 Thomas
5,738,409 A 4/1998 Bursik
5,873,624 A 2/1999 Simpson
5,992,929 A 11/1999 Liu
6,082,813 A 7/2000 Chen
6,129,415 A 10/2000 Galloway
6,247,749 B1 6/2001 Yu
6,398,297 B1 * 6/2002 Cantwell ..... A47C 3/029 297/133
6,402,243 B1 6/2002 Liu
6,439,656 B1 * 8/2002 Liu ..... A47C 3/029 297/271.6
6,634,705 B1 10/2003 Zheng
6,682,135 B2 1/2004 Zheng
6,736,450 B2 5/2004 Miyagi
6,827,401 B2 12/2004 Marshall
6,839,918 B1 1/2005 Jensen
6,926,356 B2 8/2005 Chen
7,066,534 B2 6/2006 Choi
7,077,422 B2 7/2006 Haury
7,100,975 B1 9/2006 Zheng
7,384,058 B2 6/2008 Munsey
7,669,881 B2 3/2010 Haury
7,744,049 B2 6/2010 Kwon et al.
7,841,660 B2 11/2010 Wang
7,918,495 B2 4/2011 Chen
7,971,935 B2 7/2011 Saez
8,083,252 B2 12/2011 Wagner
8,100,469 B2 1/2012 Lougee
8,251,442 B2 8/2012 Grace
8,511,747 B2 8/2013 Lougee
8,864,222 B2 10/2014 Grace
9,060,611 B2 * 6/2015 Grace ..... A47C 3/025
9,282,824 B2 3/2016 Grace
9,456,694 B2 10/2016 Paul
10,213,023 B2 * 2/2019 Yang ..... A47C 4/286
2001/0028187 A1 10/2001 Kielhorn
2003/0006578 A1 1/2003 Melgarejo
2005/0077760 A1 4/2005 Smith
2006/0027773 A1 2/2006 Nordstrom et al.
2007/0216201 A1 9/2007 Hart
2010/0044939 A1 2/2010 Hurwitz
2010/0072790 A1 3/2010 Pleiman
2010/0096894 A1 4/2010 Fukai
2010/0308632 A1 12/2010 Abolkheir
2011/0306906 A1 12/2011 Lin
2012/0055378 A1 3/2012 Stamper
2012/0256449 A1 10/2012 Chamberlain et al.
2013/0026799 A1 1/2013 Miller
2014/0138995 A1 5/2014 Leib

(56) References Cited

U.S. PATENT DOCUMENTS

FOREIGN PATENT DOCUMENTS

| | | | |
|---|---|---|---|
| CN | 200938960 | Y | 8/2007 |
| CN | 201131505 | Y | 10/2008 |
| CN | 101410036 | | 4/2009 |
| DE | 1554179 | | 5/1970 |
| DE | 202008000093 | U1 | 1/2009 |
| EP | 2220966 | A1 | 8/2010 |
| FR | 1232555 | A | 10/1960 |
| JP | H07-23833 | A | 1/1995 |
| JP | 3036662 | U | 5/1997 |
| JP | H11-318627 | A | 11/1999 |
| JP | 3079374 | | 8/2000 |
| JP | 2001-61597 | A | 3/2001 |
| KR | 200172215 | Y1 | 3/2000 |
| NO | 156634 | B | 7/1987 |
| TW | 293263 | | 12/1996 |
| TW | 401788 | U | 8/2000 |
| TW | M339247 | | 9/2008 |
| WO | 02/17750 | A1 | 3/2002 |
| WO | WO 2002/098260 | | 12/2002 |
| WO | WO 2014/055990 | A1 | 4/2014 |

OTHER PUBLICATIONS

Written Opinion for PCT/US2013/063721 dated Jan. 9, 2014.

*In re Certain Collapsible and Portable Furniture*, Inv. No. 337-1178, Amended Complaint (Public Version), Aug. 29, 2019.

*In re Ceriain Collapsible and Portable Furniture*, Inv. No. 337-1178, Federal Register Notice of Institution of Investigation, Oct. 3, 2019.

*In re Certain Collapsible and Portable Furniture*, Inv. No. 337-1178, Respondent Denovo Brands, LLC's Response to the Amended Complaint and Notice of Investigation (Public Version), Nov. 11, 2109.

*In re Certain Collapsible and Portable Furniture*, Inv. No. 337-1178, Response of Westfield Outdoor, Inc. to the Amended Complaint and Notice of Investigation (Public Version), Nov. 12, 2019.

*In re Certain Collapsible and Portable Furniture*, Inv. No. 337-1178, Response of MacSports Inc. and Meike (Qingdao) Leisure Products Co., Ltd. To the Amended Complaint and Notice of Investigation (Public Version), Nov. 12, 2019.

*In re Certain Collapsible and Portable Furniture*, Inv. No. 337-1178, Respondent Zhenli Industrial Co., Ltd.'s Response to the Amended Complaint and Notice of Investigation (Public Version), Nov. 21, 2019.

*In re Certain Collapsible and Portable Furniture*, Inv. No. 337-1178, Joint Claim Construction Chart, Nov. 22, 2019.

*In re Certain Collapsible and Portable Furniture*, Inv. No. 337-1178, Respondents MacSports Inc. and Meike (Qingdao) Leisure Products Co., Ltd.'s Notice of Prior Art, Nov. 22, 2019.

*In re Certain Collapsible and Portable Furniture*, Inv. No. 337-1178, Respondent Denovo Brands, LLc and Zhenli Industrial Co., Ltd.'s Notice of Prior Art, Nov. 22, 2019.

*In re Certain Collapsible and Portable Furniture*, Inv. No. 337-1178, Respondent Westfield Outdoor, Inc.'s Notice of Prior Art, Nov. 22, 2019.

*In re Certain Collapsible and Portable Furniture*, Inv. No. 337-1178, Expert Report of James B. Babcock on Respondents Denovo Brands LLC and Zhenli (Zangzhou) Industrial Products Co., Ltd.'s Contention That the Asserted Claims of U.S. Pat. No. 9,282,824 Are Invalid, Exhs. T-W, Feb. 5, 2020.

*In re Certain Collapsible and Portable Furniture*, Inv. No. 337-1178, Corrected Exhibit S for Respondents Denovo Brands LLC and Zhenli (Zhangzhou) Industrial Products Co., Ltd.'s Unopposed Motion for Leave to Correct Exhibits S and T to the Expert Report of James Babcock on the Invalidity of the '824 Patent, Mar. 3, 2020.

*In re Certain Collapsible and Portable Furniture*, Inv. No. 337-1178, Consent Order for Fujian Zenithen Consumer Products Co., Ltd., Zenithen Hong Kong Ltd., and Zenithen USA LLC, Mar. 13, 2020.

*In re Certain Collapsible and Portable Furniture*, Inv. No. 337-1178, Respondents Denovo Brands LLC and Zhenli (Zhangzhou) Industrial Products Co., Ltd.'s Motion for Partial Summary Determination of Non-infringement of the '824 Patent and Failure to Meet the Technical Prong of the Domestic Industry Requirement (Public Version), Mar. 20, 2020.

*In re Certain Collapsible and Portable Furniture*, Inv. No. 337-1178, Respondents Denovo Brands LLC and Zhenli (Zhangzhou) Industrial Products Co., Ltd.'s Motion for Partial Summary Determination of the Invalidity of U.S. Pat. No. 9,282,824 (Public Version), Mar. 20, 2020.

*In re Certain Collapsible and Portable Furniture*, Inv. No, 337-1178, Exhibits A-S for Respondents Denovo Brands LLC and Zhenli (Zhangzhou) Industrial Products Co., Ltd.'s Motion for Partial Summary Determination of the Invalidity of U.S. Pat. No. 9,282,824 (Public Version), Mar. 20, 2020.

*In re Certain Collapsible and Portable Furniture*, Inv. No. 337-1178, Exhibits T-EE for Respondents Denovo Brands LLC and Zhenli (Zhangzhou) Industrial Products Co., Ltd.'s Motion for Partial Summary Determination of the Invalidity of U.S. Pat. No. 9,282,824 (Public Version), Mar. 20, 2020.

*In re Certain Collapsible and Portable Furniture*, Inv. No. 337-1178, Respondent Westfield Outdoor, Inc.'s Motion for Summary Determination (Public Version), Mar. 20, 2020.

*In re Certain Collapsible and Portable Furniture*, Inv. No. 337-1178, Exhibits 1-6 for Respondent Westfield Outdoor, Inc.'s Motion for Summary Determination (Public Version), Mar. 20, 2020.

*In re Certain Collapsible and Portable Furniture*, Inv. No, 337-1178, Exhibit 7, part 1, for Respondent Westfield Outdoor, Inc.'s Motion for Summary Determination (Public Version), Mar. 20, 2020.

*In re Certain Collapsible and Portable Furniture*, Inv. No. 337-1178, Exhibit 7, part 2, for Respondent Westfield Outdoor, Inc.'s Motion for Summary Determination (Public Version), Mar. 20, 2020.

*In re Certain Collapsible and Portable Furniture*, Inv. No. 337-1178, Exhibits 8-23 for Respondent Westfield Outdoor, Inc.'s Motion for Summary Determination (Public Version), Mar. 20, 2020.

*In re Certain Collapsible and Portable Furniture*, Inv. No. 337-1178, Respondents MacSports Inc. and Meike (Qingdao) Leisure Products Co., Ltd.'s Motion for Summary Determination of Non-Infringement of U.S. Pat. No. 9,060,611 (Public Version), Mar. 20, 2020.

*In re Certain Collapsible and Portable Furniture*, Inv. No. 337-1178, Complainant GCI Outdoor, Inc.'s Memorandum in Opposition to Respondents Denovo Brands LLC and Zhenli (Zhangzhou) Industrial Products Co., Ltd.'s Motion for Partial Summary Determination of Non-infringement of the '824 Patent and Failure to Meet the Technical Prong of the Domestic Industry Requirement (Public Version), Apr. 1, 2020.

*In re Certain Collapsible and Portable Furniture*, Inv. No. 337-1178, Complainant GCI Outdoor, Inc.'s Opposition to Respondent Westfield Outdoor, Inc.'s Motion for Summary Determination (Public Version), Apr. 1, 2020.

*In re Certain Collapsible and Portable Furniture*, Inv. No. 337-1178, Complainant GCI Outdoor, Inc.'s Memorandum in Opposition to Respondents Denovo Brands LLC and Zhenli (Zhangzhou) Industrial Products Co., Ltd.'s Motion for Partial Summary Determination of the Invalidity of U.S. Pat. No. 9,282,824 (Public Version), Apr. 1, 2020.

*In re Certain Collapsible arid Portable Furniture*, Inv. No. 337-1178, Complainant GCI Outdoor, Inc.'s Opposition to Respondents MacSports Inc. and Meike (Qingdao) Leisure Products Co., Ltd.'s Motion for Summary Determination of Non-Infringement of U.S. Pat. No. 9,060,611 (Public Version), Apr. 1, 2020.

*In re Certain Collapsible and Portable Furniture*, Inv. No. 337-1178, Respondents' Pre-Hearing Statement (Public Version), Apr. 15, 2020.

*In re Certain Collapsible and Portable Furniture*, Inv. No. 337-1178, Prehearing Statement of Complainant GCI Outdoor, Inc. (Public Version), Apr. 15, 2020.

(56) References Cited

OTHER PUBLICATIONS

*In re Certain Collapsible and Portable Furniture*, Inv. No. 337-1178, Teleconference Transcript, Jul. 17, 2020 (pp. 1-64), Jul. 27, 2020.
*In re Certain Collapsible and Portable Furniture*, Inv. No. 337-1178, Order 19, Denying MacSports SD Motion (Public Version), Sep. 18, 2020.
*In re Certain Collapsible and Portable Furniture*, Inv. No. 337-1178, Order 20, Denying Westfield SD Motion (Public Version), Sep. 18, 2020.
*In re Certain Collapsible and Portable Furniture*, Inv. No. 337-1178, Order 21, Denying Denovo MSD on Invalidity (Public Version), Sep. 18, 2020.
*In re Certain Collapsible and Portable Furniture*, Inv. No. 337-1178, Order 22, Denying Denovo and Zhenli Motion for SD on NI (Public Version), Oct. 2, 2020.

* cited by examiner

COLLAPSIBLE AND PORTABLE ROCKING CHAIR

CROSS-REFERENCE TO RELATED APPLICATION

This application claims the benefit under 35 U.S.C. § 119(e) of U.S. Provisional Application No. 62/573,969, filed Oct. 18, 2017, which is incorporated herein by reference in its entirety.

FIELD OF THE INVENTION

The present invention generally relates to folding chairs, and more particularly relates to improvements in rocking chairs that are foldable and unfoldable between a set-up condition for use and a substantially collapsed condition for transportation and/or storage.

BACKGROUND OF THE INVENTION

Popularity of the mini van, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved collapsible furniture for the picnicker, sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort. The wooden beach chairs and lawn furniture of an earlier era have generally been replaced by light-weight tubular metal furniture of a more modern design. However, little has been done to optimize the collapsibility and portability of the full-sized article without compromising comfort, which is a goal of the present invention.

Beach and lawn chairs adapted to be folded for transportation and/or storage typically have a frame fabricated from elongated structural members, preferably metal. The frames of such chairs have transversely spaced-apart left-hand and right-hand frame side assemblies that are substantially parallel to each other. In a set-up condition, each frame side assembly has a front leg member and a rear leg member connected directly or indirectly to an upper end of the front leg member. For example, in some designs, the front leg member extends in a generally vertically upward direction and the rear leg member is pivotally connected at its upper end directly or indirectly to the front leg member and further is rearwardly and downwardly inclined from the upper end of the front leg member. In other designs, such as illustrated in FIG. 1, the front leg member and the rear leg member crisscross and are pivotally connected to one another at an intermediate location of each leg member. Such frame side assemblies also often include an upwardly extending chair back support member which, as shown, for example, in FIG. 1, is pivotally connected at its lower end to the rear leg member intermediate the ends of the rear leg member by an over-the-center linkage that positions the back support member so that it is supported at its lower end on the rear leg member and inclined upwardly and rearwardly therefrom when the chair is unfolded from its closed or flatly folded storage condition to its open or set-up condition for use. Such frames often also include armrests extending forward from the back support members and connected by some means to the front leg members. Lastly, such frame side assemblies may also include a seat support member generally supported by the front and rear leg members in a generally horizontal condition when the chair is in its set-up condition.

Conventional beach and lawn chairs of the prior art having the left-hand and right-hand frame side assemblies such as hereinbefore generally described also commonly have transversely extending rigid connecting members providing fixed connection between the front leg members, the rear leg members, and often the back support members as well. Additional rigidly fixed transverse connecting members may also extend between the structural members that support the seat of such a chair. The aforesaid rigid or non-collapsible transversely extending connecting members are either generally horizontally disposed or transversely diagonally extending when such a conventional prior art chair is in its set-up condition.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. Due to the intricate interconnection of all the frame members, both front-to-back and side-to-side, such chairs often require all the legs to remain in contact with the ground to ensure safety and structural integrity of the chair during use. However, there is a desire for a rocking chair that is likewise foldable and portable, so that a user at a picnic or an outdoor event can rock in their chair or recline as desired. Prior art foldable and portable chairs, such as those described above, have not been capable of rocking due to the design and construction of such chairs. Adding components to help the user rock in the chair while seated has often compromised the ability to fold the chair for storage or keep it sufficiently lightweight for easy transportation. Moreover, existing foldable rocking chair design, such as illustrated in FIG. 1, are typically not suitable for most outdoor uses, especially on soft ground or sand. The limitations of such prior art chairs are mostly due to the use of arched rails to support the chair frame. With such arched rails, each side of the chair only maintains a single contact point with the ground, which on sand or soft ground increases the risk that one or both sides of the chair will sink into or get bogged down, affecting rocking of the chair and, more significantly, affecting the integrity and safety of the chair to support a seated user.

An additional limitation of prior art rocking chairs, such as shown in FIG. 1, is that they can only be used as a rocking chair, and cannot be stabilized to be used as a normal chair that does not rock. It is desirable for many modern uses of such chairs to have the option to use the chair in multiple modes.

Other chair designs have been developed that can be folded to a collapsed or bundled state occupying less storage space. For example, some chair designs can be folded in multiple directions, reducing at least the front/back and left/right dimensions between an unfolded set-up condition and a folded, storage condition. However, these chair designs are typically not suitable for certain outdoor uses, such as at the beach or at a picnic. Heretofore, multi-directional foldable chairs have not been capable of rocking due to the complexity of the means of connecting the various frame members constituting the chair frame, as well as the need to keep all the legs of such chairs grounded to ensure safety and integrity of the chair during use. Moreover, the addition of rocking means, such as the afore-mentioned arched rails, affect the ability of the chair frame to collapse to an effective bundled footprint.

In view of the foregoing, there is a need for a chair that can be rocked by a seated user when in a set-up condition that can also be collapsed in order to reduce the space occupied by the chair in a folded condition. Further, there is a need for such a chair that can be folded with minimal effort, without limiting or compromising the structural features permitting rocking of the chair. Further, there is a need for a chair that can be rocked by a seated user, as desired, without compromising the folding and transport or the chair, and without affecting the safety and structural integrity of the chair, especially on all types of surfaces, including soft ground and sand. Accordingly, it is a general object of the present invention to provide a foldable and portable rocking chair design that overcomes the problems and drawbacks associated with folding chairs and rocking chairs, and therefore significantly improves the utility of such a chair in the set-up condition while permitting easy transportation and/or storage in a collapsed condition.

In general, there is a need for a collapsible chair that can be easily folded by a user with minimal effort, and which, when set-up, can be used both as a standard, stabilized chair, or alternately, as a rocker, without the need for the user to change the structure of the chair, in any way.

The present invention addresses these issues, and provides a means to circumvent the associated drawbacks of such prior art foldable chair designs.

SUMMARY OF THE INVENTION

The present invention is directed to a collapsible and portable rocking chair design especially suitable for use as a beach chair, a lawn chair, and the like, where the chair, in a set-up condition, can be rocked by a seated user, and where the chair can be folded from the set-up condition to a collapsed condition for transportation and/or storage.

In accordance with an embodiment of the present invention, a collapsible and portable rocking chair includes left and right frame side assemblies collectively defining forward and rear leg portions, seat support members and back support members. The chair also includes transverse connectors connecting the left and right frame said assemblies and transversely supporting the frame in the set-up condition of the chair. Pairs of connectors are pivotally connected to one another as well as to the left and right frame side assemblies to facilitate folding of the chair frame to a collapsed and preferably bundled condition. In a preferred design, the pairs of connectors each comprise front and rear portions that are pivotally connected about respective central pivot points to generally assume the shape of an X when the chair is in the set-up condition and that are disposed in generally parallel relationship when the chair is folded or collapsed for transportation and/or storage. The chair further includes a seat panel supported by the seat support and a backrest panel supported by the backrest support for collectively accommodating a user seated in the chair, though such panels need not be discrete and can be formed from a single or connected panel of fabric.

The left and right frame side assemblies of the chair in accordance with preferred embodiments may also include left and right armrests, respectively. The armrests are pivotally attached at their back end to the back support members and adapted for adjustment, in connection with said back support members, to recline the backrest of the chair in its set-up condition. In this regard, the forward end of each armrest includes an adjustment mechanism for unlocking, moving, and then locking the reclined position of the backrest. In an embodiment of the present invention, the forward end of each armrest is pivotally mounted to a support member that also is pivotally attached to a sliding sleeve on a front leg member.

In preferred embodiments of the rocking chair, each frame side assembly is supported on a fulcrum point for rocking movement of the chair frame. In preferred embodiments of the present invention, the fulcrum point is provided at the end of a fulcrum member extending downward from each side frame assembly at a position located between the front leg and the rear leg. In further preferred embodiments, the fulcrum members can be integral with the back support members. Each side frame assembly preferably utilizes a static runner design whereby each side frame assembly generally maintains contact with the ground or support surface during use of the chair, either as a normal, fully stabilized chair, or during rocking of the chair back-and-forth, via the runner. The lower end of the fulcrum member and the lower end of the rear leg portion each pivotally contact the runner. In alternate designs, the runner may be completely replaced by multiple contact points, including at least one fulcrum point on each side frame assembly, again with the chair operating as a normal, fully stabilized chair or as a rocker with two or more contact points with the ground or support surface during use of the chair.

In preferred embodiments of the rocking chair, a rocker mechanism is attached to or provided as part of the chair frame to support the chair during rocking movement and to facilitate rocking of the chair in connection with the user's shifting weight. In one embodiment, the rocker mechanism comprising a tubular extension member projecting outwardly and downwardly as part of the rear leg portion of each side frame assembly and received within a sleeve housing a compression spring to which the tubular extension member is attached. The lower end of the sleeve is associated with a foot that contacts the static runner, ground or support surface for bracing the chair as it is rocking, with the compression spring damping the chair as it rocks backwards and biasing the chair forwards.

In an alternate embodiment of the rocking chair, a rocker mechanism may be provided in connection with a front leg member or forward portion of the frame side assemblies, either in combination with or in lieu of the rear rocker mechanism. In another alternate embodiment, a rocker mechanism may be provided in connection with both the front leg member and a rear leg member on each side of the chair frame, each positioned about a fulcrum point. In still another alternate embodiment, the rocker mechanism comprises a torsion spring operatively associated with the fulcrum point of each frame side assembly.

Accordingly, in a first aspect of the present invention, a collapsible and portable rocking chair comprises a chair frame comprising a pair of frame side assemblies having substantially mirrored construction and being relatively movable with respect to one another between a set-up condition of said chair where said frame side assemblies are transversely spaced apart from one another and a collapsed condition of said chair where said frame side assemblies are generally adjacent to one another and the members thereof are further collapsed relative to one another to a bundled condition. In this regard, the chair collapses like a standard X-Y chair known in the art where the chair frame collapses in both a transverse (side-to-side) direction and a lengthwise (front-to-back) direction essentially simultaneously. Each frame side assembly includes a front leg portion and a rear leg portion that are respectively connected to a mirrored portion by transversely extending front and rear connector assemblies pivotally moveable between a set-up condition and a closed condition. The open and closed conditions of the transverse connectors generally correspond to the set-up and collapsed conditions of the chair. The chair further comprises a fulcrum point supporting the chair frame and about which said chair frame can move between forward and rearward positions, and at least one rocker mechanism attached to the rear leg portion of chair frame for supporting the chair during movement of the chair frame between said forward and rearward positions.

In another aspect of the present invention, the chair can be used as a normal, stabilized chair in its forward position and will only rock when the user chooses to rock. In this regard, the chair of the present invention is distinct from prior art rocking chair designs in which the chair is capable of rocking at all times, often by the slightest shift of the user's weight.

In accordance with another embodiment of the present invention, a collapsible and portable rocking chair includes left and right frame side assemblies collectively defining forward and rear leg portions, and back support members for supporting a seating panel. Additional seat support members extend from the back support members and the front leg portions in the set-up condition of the chair to aide in supporting the front corners of the seating panel. The chair also includes transverse connectors connecting the left and right frame said assemblies and transversely supporting the frame in the set-up condition of the chair. Pairs of connectors are pivotally connected to one another as well as to the left and right frame side assemblies to facilitate folding of the chair frame to a collapsed condition. In a preferred design, the pairs of connectors each comprise front and rear portions that are pivotally connected about respective central pivot points to generally assume the shape of an X when the chair is in the set-up condition and that are disposed in generally parallel relationship when the chair is folded or collapsed for transportation and/or storage. The seating panel preferably has a one-piece bucket design supported at its four corners by the chair frame.

These and other features of the present invention are described with reference to the drawings of preferred embodiments of a collapsible and portable rocking chair. The illustrated embodiments of features of the present invention are intended to illustrate, but not limit the invention.

DETAILED DESCRIPTION OF EMBODIMENTS OF THE INVENTION

Figure 8:
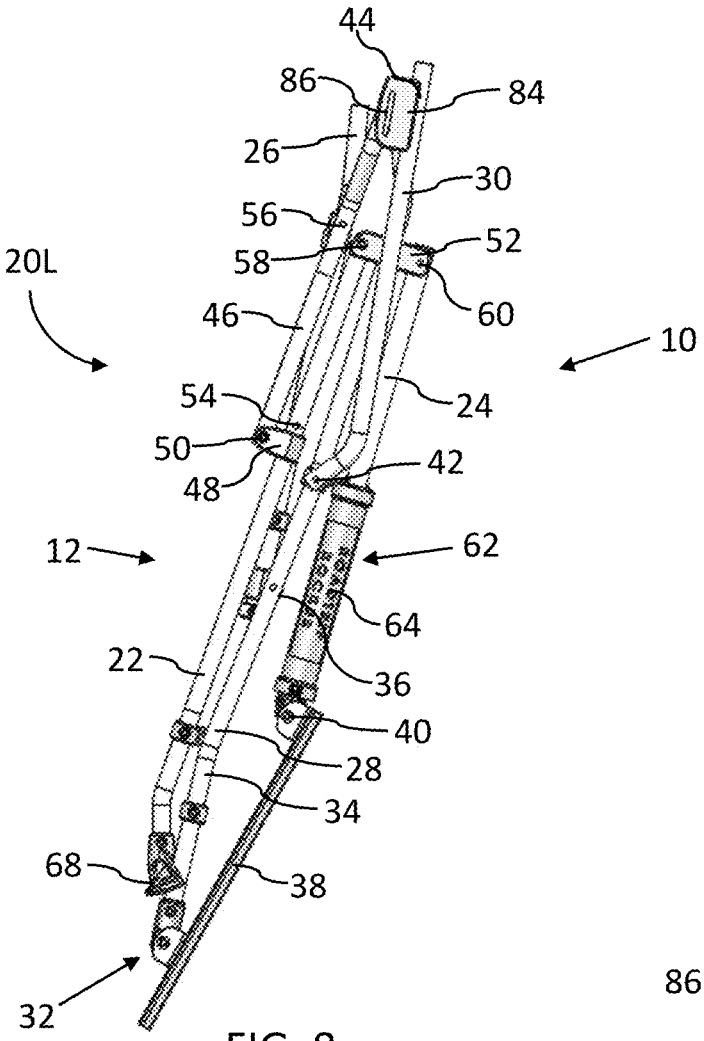
FIG. 8 is a planar side view of the rocking chair of FIG. 2 in its collapsed condition.

In the drawings and in the description that follows, the present invention is illustrated and described with reference to collapsible and portable rocking chair designs embodying the present invention. A first embodiment of a rocking chair in accordance with the present invention is shown, for example, in FIG. 2 in a set-up condition ready for use, and generally designated as reference numeral 10. A fully collapsed and bundled condition of the chair 10 is illustrated in FIG. 8.

Figure 2:
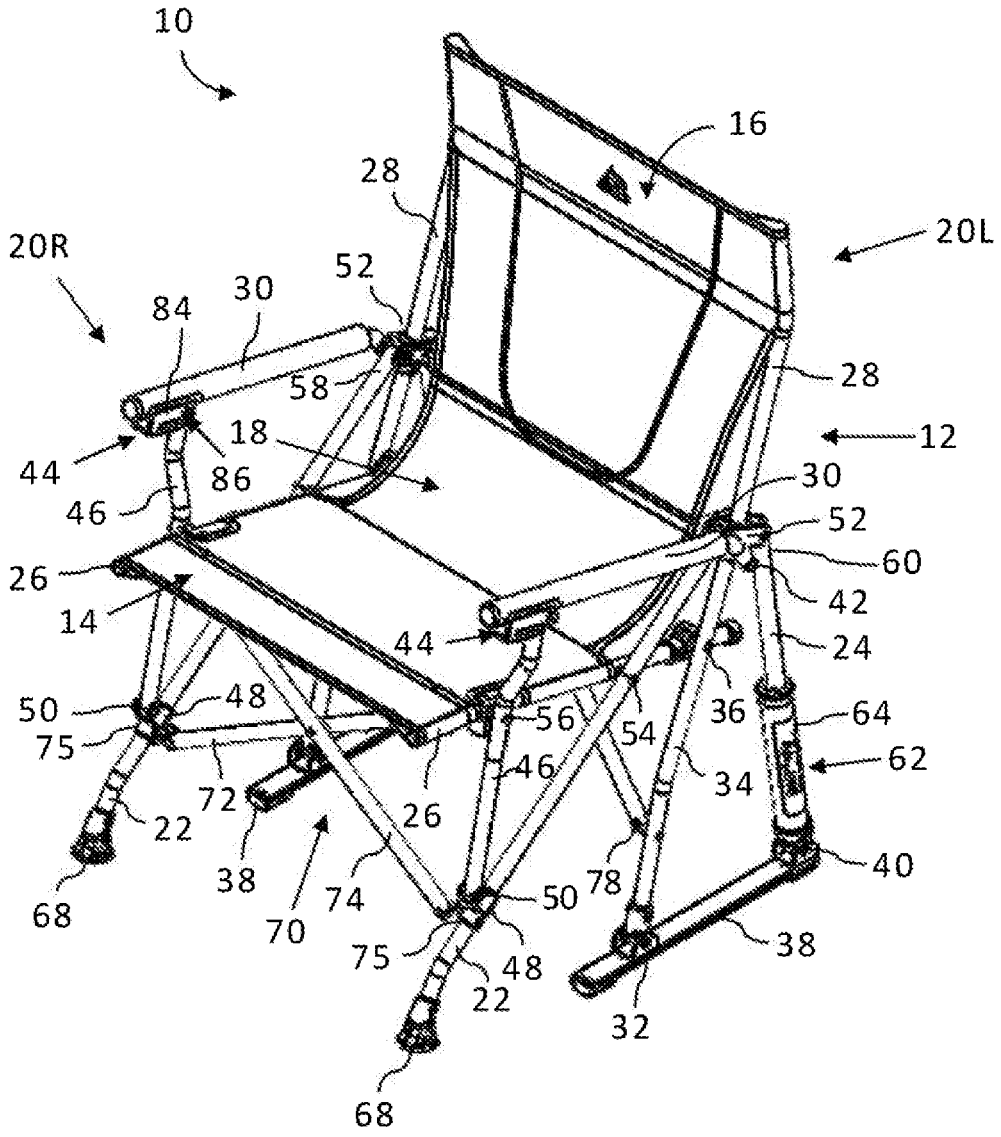
FIG. 2 is a perspective view of a collapsible and portable rocking chair in accordance with an embodiment of the present invention, with the rocking chair in a set-up condition, and with the rocking chair in a forward, stabilized position.

The chair 10 includes a frame 12 that carries a generally rectangular seat support panel 14 and a generally rectangular backrest support panel 16. As illustrated in FIG. 2, the seat panel 14 and the backrest panel 16 comprise generally flexible panels that are connected together, for example, by a flexible connector panel 18, though the panels 14 and 16 and can be separate pieces without departing from the spirit and principles of the present invention. The panels 14 and 16 are generally taut when the chair 10 is in its set-up condition for accommodating and supporting a seated user.

In general, the frame 12 is comprised of several frame members rigidly and/or pivotally connected together to define the chair frame 12 and support the seat panel 14 and the backrest panel 16, while also permitting easy folding and collapsing of the frame 12 to a condition suitable for easy transportation and storage. Preferably, the frame members are fabricated from a durable lightweight material such as a tubular metal or high-strength plastic. Various elongated structural parts or members that comprise the chair frame 12 are preferably constructed from tubular material of non-circular cross-section, such as, for example, extruded aluminum tubing having square, oval, or elliptical cross-section, or, alternately, of circular cross-section.

Figure 3:
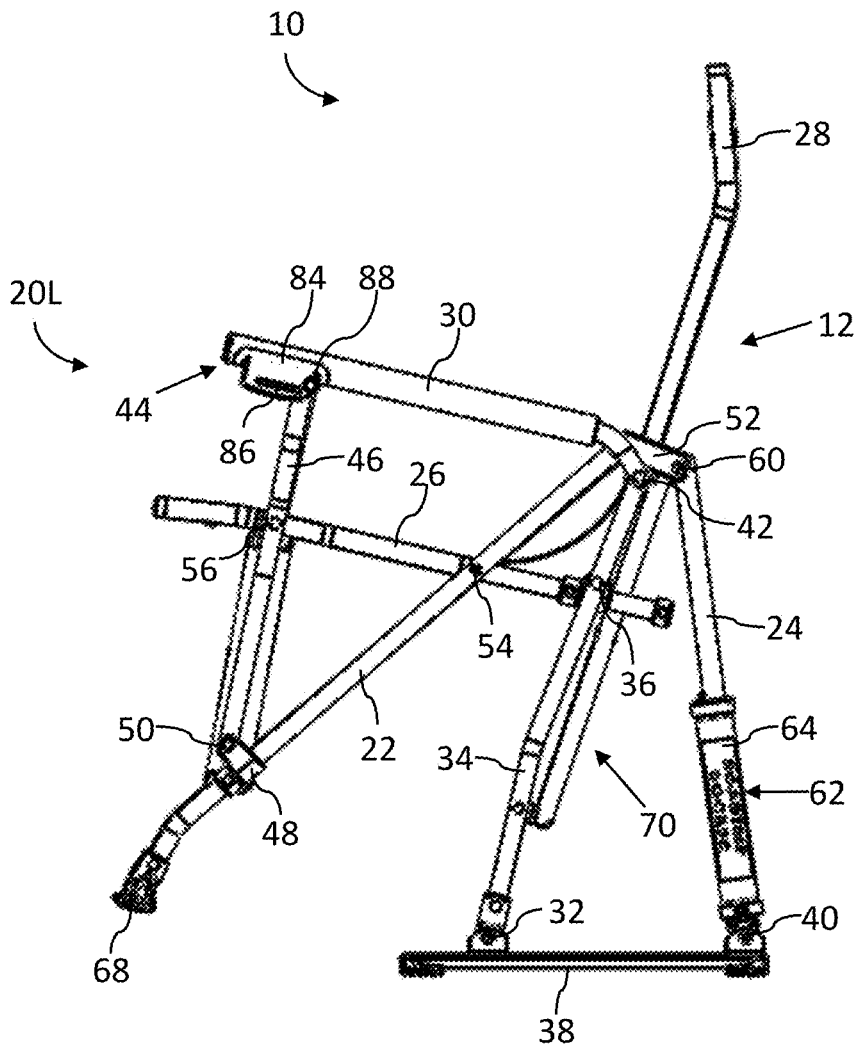
FIG. 3 is a planar side view of the rocking chair of FIG. 2, also in a forward position.
Figure 4:
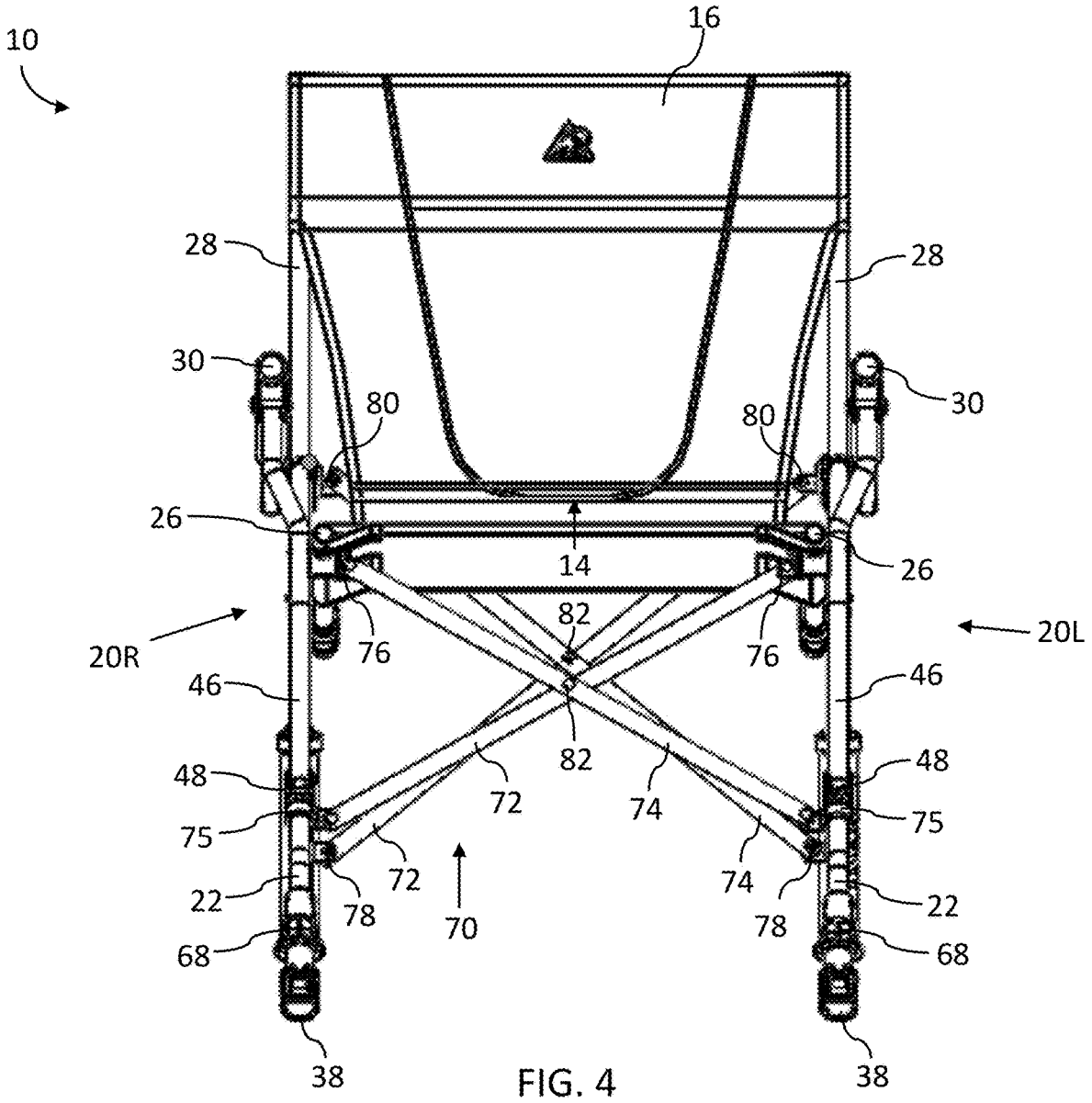
FIG. 4 is a planar front view of the rocking chair of FIG. 2.
Figure 5:
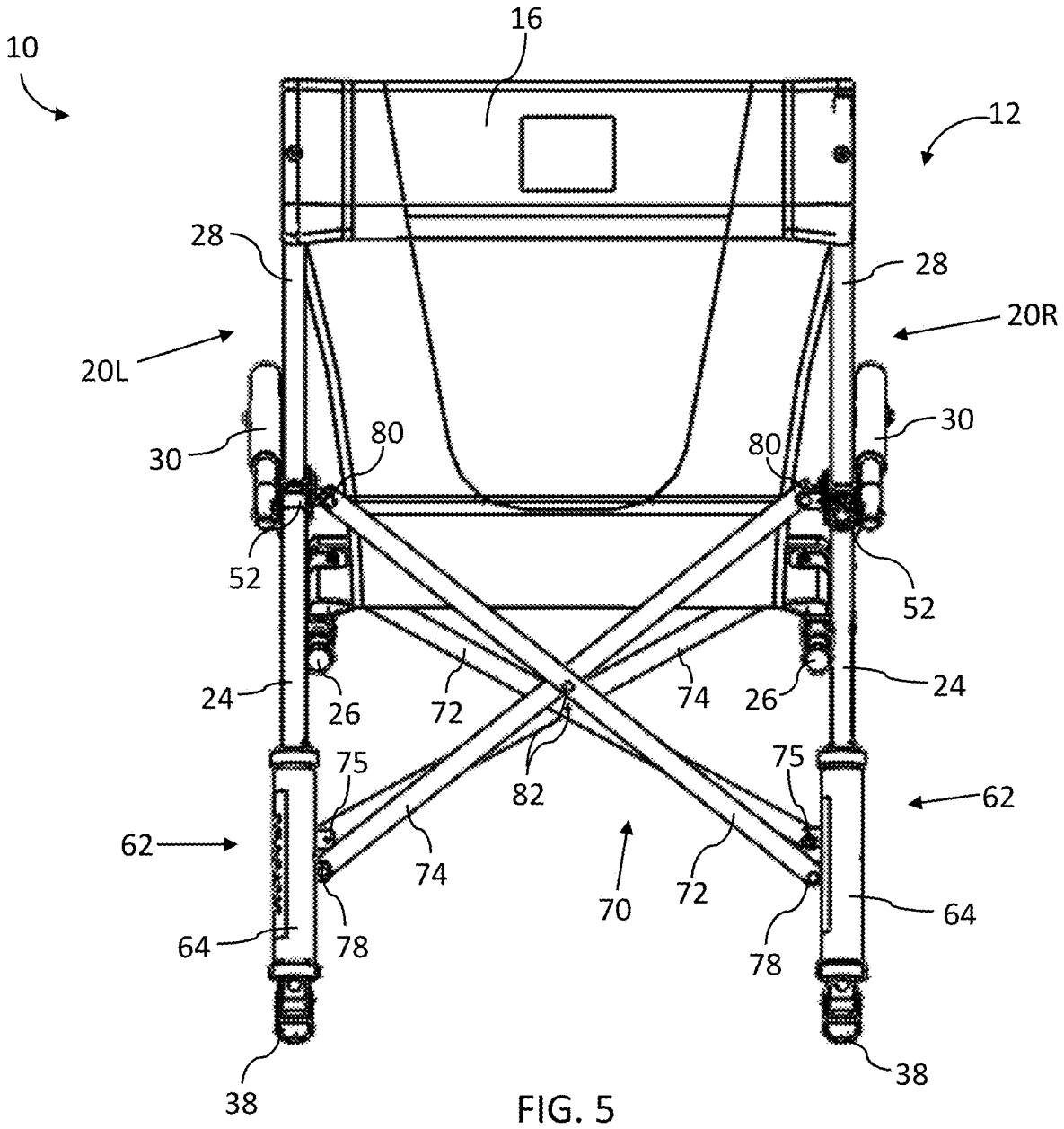
FIG. 5 is a planar rear view of the rocking chair of FIG. 2.
Figure 6:
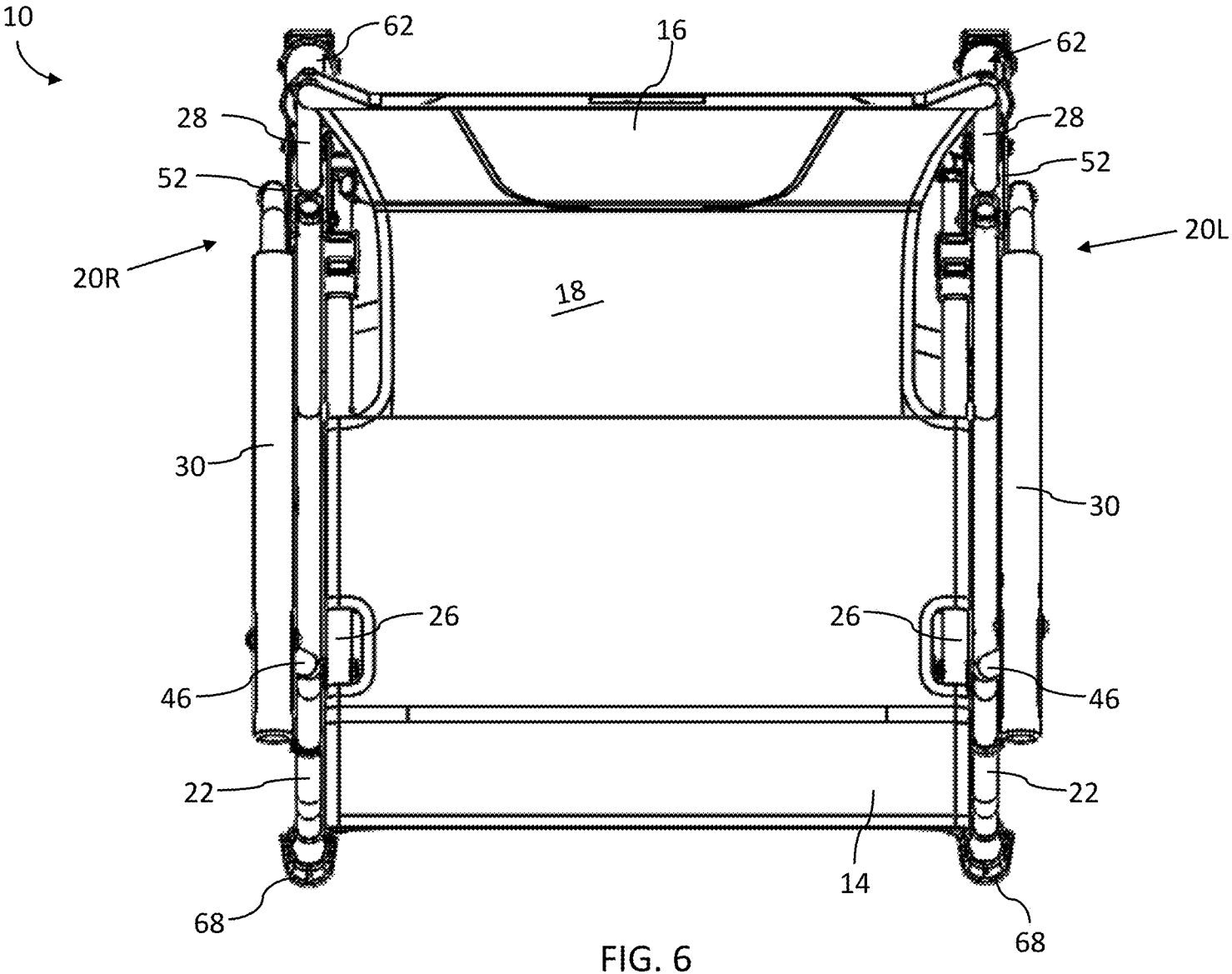
FIG. 6 is a planar top view of the rocking chair of FIG. 2.

Referring to FIGS. 2-8, the frame 12 generally has a pair of side assemblies 20 comprised of frame members and having substantially identical, but mirrored, construction. The left and right frame side assemblies, respectively designated as 20L and 20R in FIGS. 4 and 5, are disposed in laterally or transversely spaced apart and generally parallel relation to each other when the chair 10 is in its set-up condition. In the illustrated embodiment, the side frame assemblies 20L and 20R are interconnected to be collapsed to the folded and bundled condition of the chair 10, generally shown in FIG. 8. In this regard, the present invention is generally used in connection with an X-Y chair frame design as is generally known in the art. That is, when the chair is being collapsed from its set-up condition to its collapsed and bundled condition, the frame members move in both a transverse (side-to-side) direction and a lengthwise (front-to-back) direction, essentially simultaneously. The present invention is easily adaptable for use with chair frame designs that are collapsed in different manners, including but not limited to transverse, side-to-side folding or front-to-back folding generally associated with standard folding chairs.

Considering now one embodiment of a folding rocking chair in accordance with the present invention, the chair frame 12, as shown in in planar side view in FIG. 3, utilizes an open frame construction generally associated with standard folding chairs and X-Y chairs known in the art, where the frame members are interconnected by rigid, pivotal, sliding and/or telescopic joints to effect easy folding and unfolding of the chair 10 between a set-up condition (FIG. 2) and a collapsed condition (FIG. 8).

As shown, the chair frame 12 comprises left-hand and right-hand side frame assemblies 20L and 20R of substantially identical, but mirrored, construction. Each side frame assembly 20L and 20R includes a front leg member 22, a rear leg member 24, a seat support member 26, a back support member 28 and an armrest 30, all interconnected by pivotal and/or sliding connections that facilitate folding of the chair 10 between a set-up condition, as shown in FIG. 2, and a collapsed condition, as shown in FIG. 8. Each side frame assembly 20L and 20R further includes a fulcrum point 32 provided on the end of a fulcrum frame member 34 extending at an intermediate position of the frame 12 between the front leg member 22 and the rear leg member 24. In the illustrated embodiment shown for example in FIG. 3, the fulcrum frame member 34 is integral with the back support member 28, this collective frame member being pivotally connected at first pivot point 36 at the rear end of the seat support member 26 and extending down to the fulcrum point 32, which can rest relative to the ground or support surface on which the set-up chair 10 rests to facilitate rocking on and about said fulcrum point 32. As shown, the fulcrum member 34 has fulcrum pivot point 32 on its lowermost end that aids rocking of the chair 10, represented by a pivot pin that contacts a static runner 38 that sits on the ground. As further illustrated, the lower end of the rear leg member 24 also contacts the runner 38 and is pivotally connected thereto via second pivot point 40.

Referring again to FIG. 3, the rear end of the armrest 30 is pivotally connected to the back support member 28 at third pivot point 42. In preferred embodiments, the armrests 30 of the chair 10 can be adjusted and moved to effect reclining of the backrest to a desired position. In this regard, the forward end of the armrest 30 includes an adjustment mechanism 44, such as a plate with notches, whereby the user can unlock each armrest 30, move the armrests 30 to a desired position associated with a different reclined position of the backrest, and then lock the armrests 30 in that selected position. As further illustrated in FIG. 3, the forward end of the armrest 30 in each side frame assembly 20L and 20R is pivotally attached to a generally vertically extending armrest support member 46 which downwardly extends to and is pivotally connected to a slidable sleeve 48 mounted on the front leg member 22. During collapsing of the chair 10 to the condition shown in FIG. 8, the sleeve 48 slides along the front leg member 22 and the armrest support member 46 pivots relative to the front leg member 22 about fourth pivot point 50 to facilitate collapsing of the chair 10.

Still referring to FIG. 3, the front leg member 22 angles back to a pivotal connection 52 adjacent to the rear end of the armrest 30. This front leg member 22 is also pivotally connected at fifth pivot point 54 to the seat support member 26 at a position intermediate its extreme ends. The armrest support member 46 is pivotally attached at sixth pivot point 56 to the seat support member 26 at a forward end thereof, while the back support member 28 (combined with the fulcrum member 34) is pivotally attached at first pivot point 36 to the seat support member 26 at a rear end thereof.

The rear leg member 24 of each side frame assembly 20L and 20R extends rearwardly and downwardly from the pivot connection 52 positioned adjacent to the rear end of the armrest 30. As illustrated, the pivot connection 52 comprises a linkage to which the upper end of the front leg member 22 and the upper end of the rear leg member 24 are pivotally attached at seventh and eighth pivot points 58 and 60, respectively. This linkage 52 is slidingly mounted on the back support member 28 and slides along said member 28 when the chair frame 12 is collapsed, as illustrated in FIG. 8.

Figure 9:
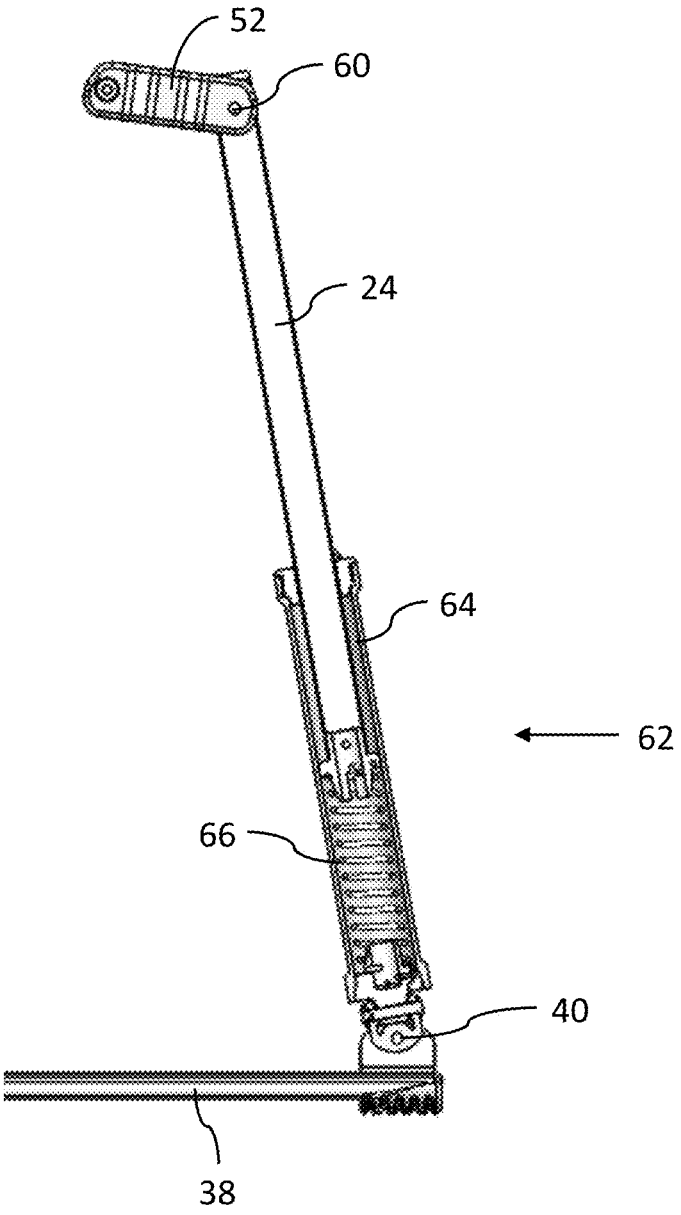
FIG. 9 is a cross-sectional view of a rocker mechanism for use with the rocking chair of FIG. 2.

As illustrated in FIG. 3 and shown in more detail in FIG. 9, the rear leg member 24 includes a built in rocker mechanism 62. As illustrated, each rear leg member 24 is associated with a sleeve or tube 64 that receives the lower-most end of the rear leg member 24. In effect, the rocker mechanism 62 and sleeve 64 form part of the rear leg member 24 relative to the other portions of the chair frame 12. Within the sleeve or tube 64, the rear leg member 24 rests atop a spring 66 disposed therein. During rocking movement of the chair 10, the rear leg member 24 presses down on the spring 66, which dampens the force of the chair frame 12 (and the weight of the seated user) pressing down on the spring 66, while also biasing the rear leg member 24 in the return direction. When a seated user leans back in the chair 10, the rear leg members 24 slide within the respective sleeves 64, allowing the chair frame 12 to recline while pressing down on the springs 66 within the sleeves 64. The springs 66 dampen the rearward force of the chair 10 while biasing the rear leg members 24 upwardly, and as a result, the chair 10 in a forward direction. In accordance with a normal rocking motion, when the user's weight shifts forward, the chair frame 12 likewise moves forward. The rear leg members 24 slide up from within their respective sleeves 64 and remove the force on the rear springs 66. As so designed, the sleeves 64 on each of the rear leg members 24 maintain contact with the ground surface (or the static runner 38, as shown) at all times during use of the chair 10.

Figure 1:
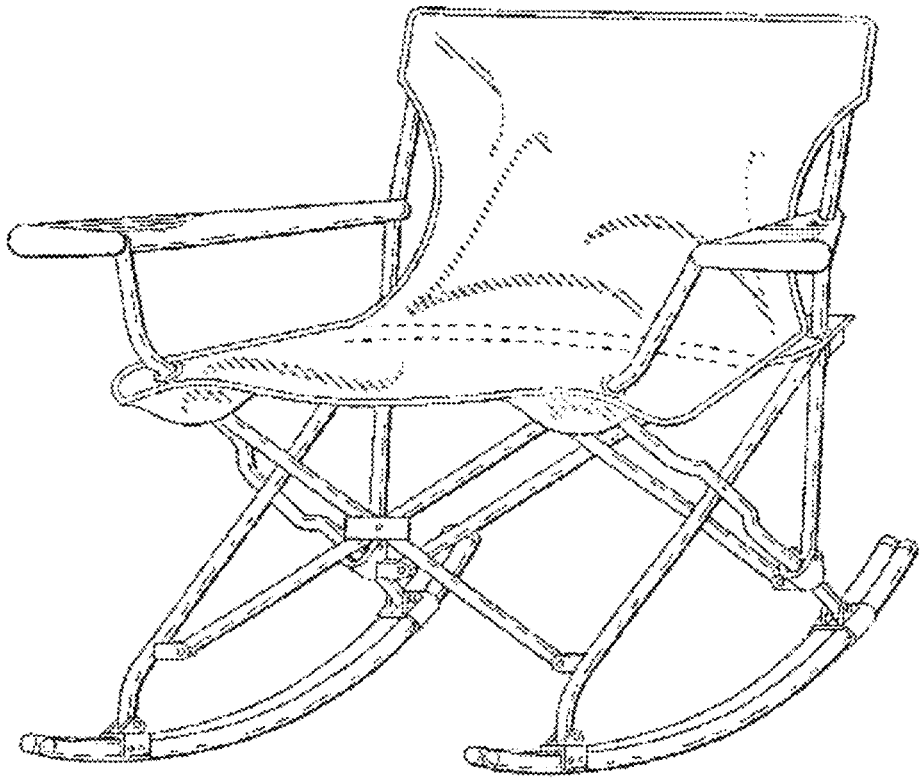
FIG. 1 Prior Art
FIG. 1 is a perspective view of a prior art collapsible and portable rocking chair with the chair in a set-up condition for rocking by a seated user.

Referring again to FIG. 3, the rocker mechanism 62, as attached to the rear leg member 24, extends angularly outwardly and downwardly from the backside of the chair frame 12—generally at the location where the armrest 30, the rear leg member 24, the front leg member 22 and the backrest support member 28 converge together—to the support runner 38 for supporting and facilitating a back-and-forth rocking movement of the chair 10 when a seated user wants to rock. The rocker mechanism 62 is preferably attached to a static runner design, such as illustrated, which presents a significant improvement over prior art rocking chair designs using arched rails, such as illustrated in FIG. 1, especially in regards to use on soft ground or sand, on which prior art rocking chair designs are ill-suited.

Referring to FIG. 9, the rocker mechanism 62 comprises, as discussed above, a sleeve 64 that receives the axially-elongated tubular member of the rear leg member 24. More particularly, the end of the rear leg member 24 is attached to a spring 66 contained within the sleeve 64 and itself fixed at a lower end to the sleeve 64. The lower end of the sleeve 64 is pivotally connected at second pivot point 40 to the support runner 38 via a universal joint and pivot pin for movement with the rocking chair 10. The universal joint permits some flexibility in movement to accommodate seated users of varying sizes and weights without compromising the users' ability to recline and rock in the chair 10. In an alternate design, the lower end of the sleeve 64 may merely be provided with a foot for direct contact with the support surface in absence of the support runner 38. In a still further alternate design, the rear leg member 24 and sleeve 64 of the rocker mechanism 62 can be designed to move with the rocking movement of the chair 10 such that the lower end of the sleeve 64 (i.e., the foot) lifts off the ground when the chair 10 is in a forward position and contacts the ground as the chair 10 rocks backwards to support the chair 10 in a rearward position.

Referring back to FIG. 3, the fulcrum point 32 for the chair 10 is provided on the forward end of the support runner 38 for effecting a pivoting of the chair frame 12 relative to the support runner 38 and the ground. This pivoting is what causes the chair 10 to rock. In general, as a seated user shifts her weight backward—for example, by leaning back on the backrest panel 16—the chair frame 12 pivots backwards on and about the fulcrum point 32 and is supported by the rocker mechanism 62. That is, as the chair frame 12 pivots backward, the rear leg member 24 moves with the chair frame 12, generally in a backwards and downwards direction towards the rear end of the support runner 38. As the rear leg member 24 moves, it slides downwards within the sleeve 64 of the rocker mechanism 62 applying a force on the spring 66, which dampens the rear leg member 24 and prevents the chair 10 from tipping over. The spring 66 further biases the rear leg member 24 in the opposite direction—i.e., upwards out of the sleeve 64 and upwards and forwards relative to the rear end of the support runner 38. This movement of the rear leg member 24 (often combined with an associated shift in the seated user's weight) pivots the chair frame 12 forwards on and about the fulcrum point 32. During such pivoting movement, the rear leg member 24/rocker mechanism 62 in the illustrated embodiment pivot at pivot points 60 and 40 relative to both the chair frame 12 and the support runner 38 so as to maintain contact with both. As a result, in the illustrated embodiment, the rocker mechanism 62 does not lift off the ground during rocking, which improves safety of the chair 10 by not having parts that someone can get pinched or crushed by—e.g., by getting a foot caught between the chair 10 and the ground or support surface. In alternate designs, the lower end of the rocker mechanism 62 can move with the chair frame 12 and contact the ground or support surface with movement of the chair 10.

The rocker mechanism 62 can take a variety of forms without departing from the spirit and principles of the present invention. As shown in FIG. 9, the rocker mechanism 62 comprises a compression spring 66 disposed within a sleeve 64 receiving the tubular rear leg member 24. In alternate designs, this rocker mechanism 62 can be replaced by torsion springs provided on the lower portion of each frame side member assembly 20L and 20R—for example, at the fulcrum point 32 of each frame assembly 20L and 20R on a support runner 38. Further, the rear rocker mechanism design can be replaced by a front rocker mechanism design, namely, a compression spring utilized in connection with the design of the front leg members 22 of the chair 10. Still further, combinations of springs may be used, for example, compression springs provided on both the front leg members 22 of the chair 10, as well as on a rearwardly projecting member 24 to prevent the chair 10 from tipping over as it is rocked backwards. Thus, in alternate designs of the chair 10 shown in FIG. 2, a rocker mechanism 62 can be provide on the front leg member 22 or the rear leg member 24 or both leg members 22 and 24 without departing from the intended operation of the chair 10 as a rocking chair.

The chair frame 12 is generally adapted to rest on a generally horizontally oriented supporting surface, such as a floor or the ground, in a set-up condition. In a forward position of the chair 10, the chair 10 acts as a normal, fully stabilized chair, and is supported even if the user is leaning on the backrest panel 16. If the user desires to rock in the chair 10, the user can shift her weight backwards, for example, by leaning and pushing backwards on the backrest panel 16, which will cause pivoting of the chair frame 12 relative to the fulcrum points 32 on each support runner 38. As the chair 10 pivots backwards, the front leg members 22 may lift off the ground, but the chair 10 remains stabilized by the fulcrum point 32 and the rear leg member 24 maintaining contact with the support surface (e.g., via support runner 38). As the chair 10 pivots forwards, the front leg members 22 move back into contact with the support surface.

As illustrated in FIG. 3, the lower end of each front leg member 22 generally includes a foot 68 designed for contacting the ground or support surface during use. When the front leg members 22 are contacting the ground surface, the front feet 68 help stabilize the chair 10 in its set-up condition, especially when the chair 10 is not being rocked.

Figure 7:
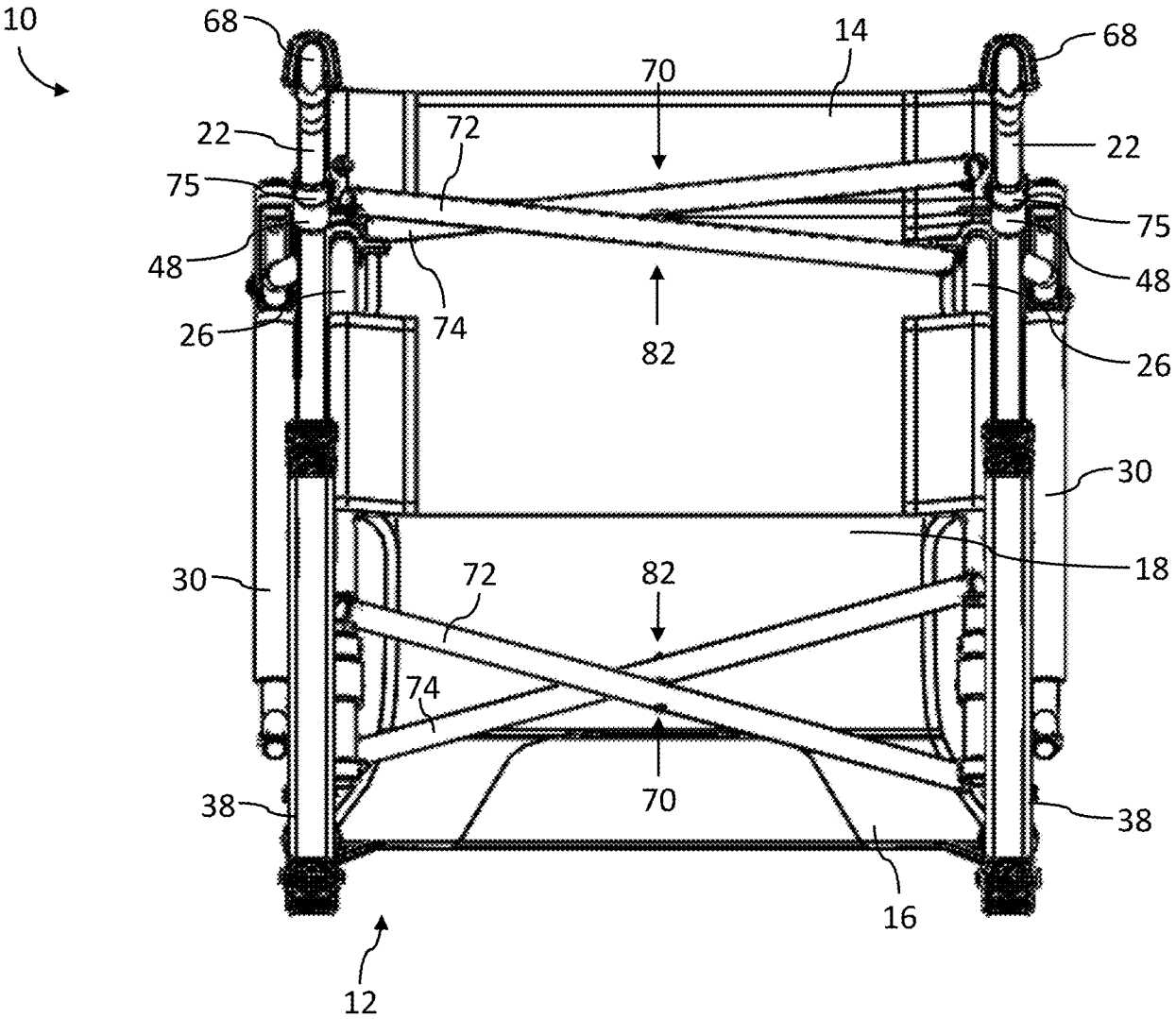
FIG. 7 is a planar bottom view of the rocking chair of FIG. 2.

The frame members for the frame side assemblies 20L and 20R are preferably disposed within generally parallelly extending vertical planes. Referring to FIGS. 4-5 and 7, the frame side assemblies 20L and 20R are connected together by transverse connector assemblies 70, each pivotally attached to the members of an associated frame side assembly 20L or 20R, as well as to each other for pivotal movement between set-up and collapsed conditions of the chair 10. More particularly, each connector assembly 70 comprises a forward connector 72 and a rearward connector 74. As best shown in FIG. 4, the front connector assembly 70 is attached between a universal joint 75 mounted at a lower end of each front leg member 22 and a universal joint 76 mounted to the forward end of each seat support member 26. As best shown in FIG. 5, the rear connector assembly 70 is attached between a universal joint 78 on the lower end of each fulcrum member 34 and a universal joint 80 attached to each linkage 52 between the upper ends of the front and rear leg members 22 and 24. Moreover the forward and rearward connectors 72 and 74 of each connector assembly 70 are pivotally connected at a midpoint 82 for pivoting between a set-up condition generally resembling a X-shape and a collapsed condition whereby the members 72 and 74 are generally parallel to one another. Accordingly, the frame side assemblies 20L and 20R are joined each to the other, to enable, in part, transverse, or left-right, folding of the frame, by the pair of movable X-frame connector assemblies 70 formed by the pivotable interconnection of the connectors 72 and 74. That is, when the chair 10 is being collapsed, the connectors 72 and 74 are pivoted to close the X-frame so that the connectors 72 and 74 are flattened and brought adjacent to one another. As the connectors 72 and 74 are flattened, the frame side assemblies 20L and 20R are brought inward and adjacent to one another as well. Moreover, in accordance with other connections of the various chair frame members, as this side-to-side movement of the frame members is occurring, the frame members further pivot and/or slide relative to one another for lengthwise, front-to-back movement of the members, until the entire frame 12 achieves it collapsed and bundled condition, as shown in FIG. 8.

The transverse connector assemblies 70 also provide support for the chair frame 12 in the open, set-up condition by balancing and redistributing the forces exerted on the chair frame 12 by a person seated on the seat panel 14 and leaning back on the backrest panel 16. As shown in FIGS. 4-5 and 7, the connectors 72 and 74 can be further secured to the frame 12 by using support braces (not shown) pivotally connected between a connector 72 or 74 and the chair frame 12.

Referring again to the design illustrated in FIG. 2, when the chair 10 is folded up for transportation and/or storage, the user simply presses inwardly on each side of the frame 12, which causes the connectors 72 and 74 of each connector assembly 70 to pivot relative to each other about their front and back pivot connections 82 from the X-shape associated with the set-up condition of the chair 10 to positions whereby the connectors 72 and 74 are generally parallelly disposed relative to each other. As the connectors 72 and 74 pivot relative to one another about the central pivot points 82, the members of the frame side assemblies 20L and 10R move, pivot and/or slide relative to one another, whereby the left and right side frame assemblies 20L and 20R begin to transversely move towards one another, while all of the members within each side frame assembly 20L and 20R pivot front-to-back towards generally parallel and adjacent relationship, as illustrated in FIG. 8. To set-up the chair 10, the user simply pulls outwardly on members from the opposing side frame assemblies 20L and 20R—generally both side-to-side and front-to-back—until the connectors 72 and 74 pivot to the desired X-shaped conditions and the chair frame 12 snaps into its set-up condition.

In the set-up condition, the flexible seat panel 14 defines a generally taut chair seat support and the flexible backrest panel 16 defines a generally taut chair back support, for collectively accommodating an upright, seated chair occupant. The seat panel 14 and the backrest panel 16 are secured to portions of the chair frame 12 that help define and provide the seat support and the back support for the occupant.

In accordance with preferred embodiments of the present invention, the seat and backrest panels 14 and 16 may be made from fabric or other suitable flexible, durable and weather resistant sheet material. In accordance with preferable designs of the chair 10, the panels 14 and 16 are flexible to accommodate the seated user, thereby improving the comfort level of the chair 10. In the set-up condition of the chair 10, the seat panel 14 and the backrest panel 16 extend between the side frame assemblies 20L and 20R and are generally taut for supporting a seated user. When the chair 10 is collapsed to a folded condition, such as shown in FIG. 8, the panels 14 and 16 become flaccid and fold within the collapsed condition of the chair 10. Thus, the design of the present invention can be used with chairs of varying heights, such as an event chair (shorter leg length) or stool (longer leg length) without affecting operation and use of the chair in accordance with the present invention. The backrest panel 16 preferably provides a high profile capable of supporting the user's upper back, neck and head, though various dimensions for the backrest panel 16 may be used without affecting operation of the chair 10 in accordance with the present invention.

The portable and collapsible rocker chair 10 in accordance with the present invention can also be fitted with additional features to improve upon their intended use as a portable chair. For example, a cup holder or side pouch (not shown) can be attached to the chair frame 12 without affecting the chair's ability to rock or be easily collapsed to a compacted bundle for transportation and/or storage.

Figure 10:
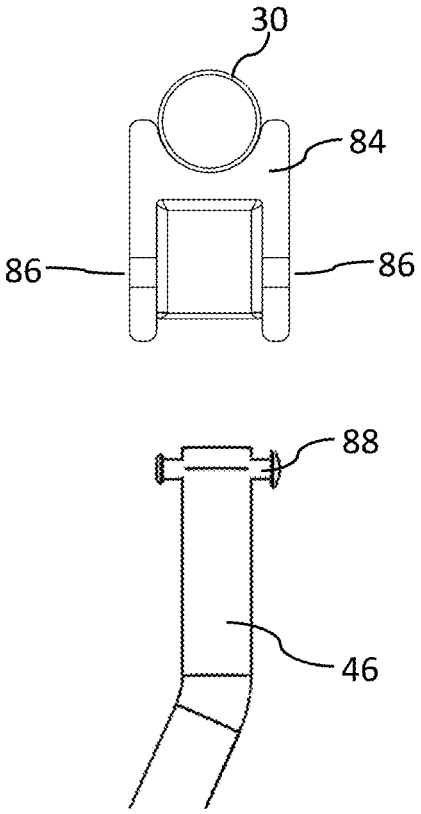
FIG. 10 is a partial cross-sectional exploded view of the connection between an armrest and a frame support member for the rocking chair of FIG. 2.

In an aspect of the chair 10 illustrated in FIG. 2, the backrest can be reclined for the seated user. In order to adjust the position of the backrest relative to the seat support, the user uses the armrests 30 and the adjustment mechanism 44 located at the forward end thereof. This adjustment mechanism 44 interacts with the upper end of the generally vertically-extending armrest support member 46, whereby the position of the armrest 30 can be changed to various positions, which adjusted positions corresponds to different reclined positions of the back support members 28. In the embodiment illustrated in FIGS. 3 and 4, the adjustment mechanism 44 comprises a plate or mount 84 having a slot 86 in which a pin 88 located on the armrest support member 46 is disposed. Referring to FIG. 10, the pin 88 can extend out of both transverse sides of the armrest support member 46 to define pawls that extend into the slots 86 on each side formed in the adjustment mount 84. The slots 86 can include stops for locking the position of the pin 88, and thereby locking the corresponding position of the backrest. In use, the armrests 30 can be lifted by the user out of a stop, slid to a new position associated with another stop, and then locked in place at that newly-selected stop position. Additionally, when the chair 10 is collapsed, the armrest 30 pivots about the pin 88 so that the armrest 30 and the armrest support member 46 move together, as illustrated in FIG. 8.

Figure 11:
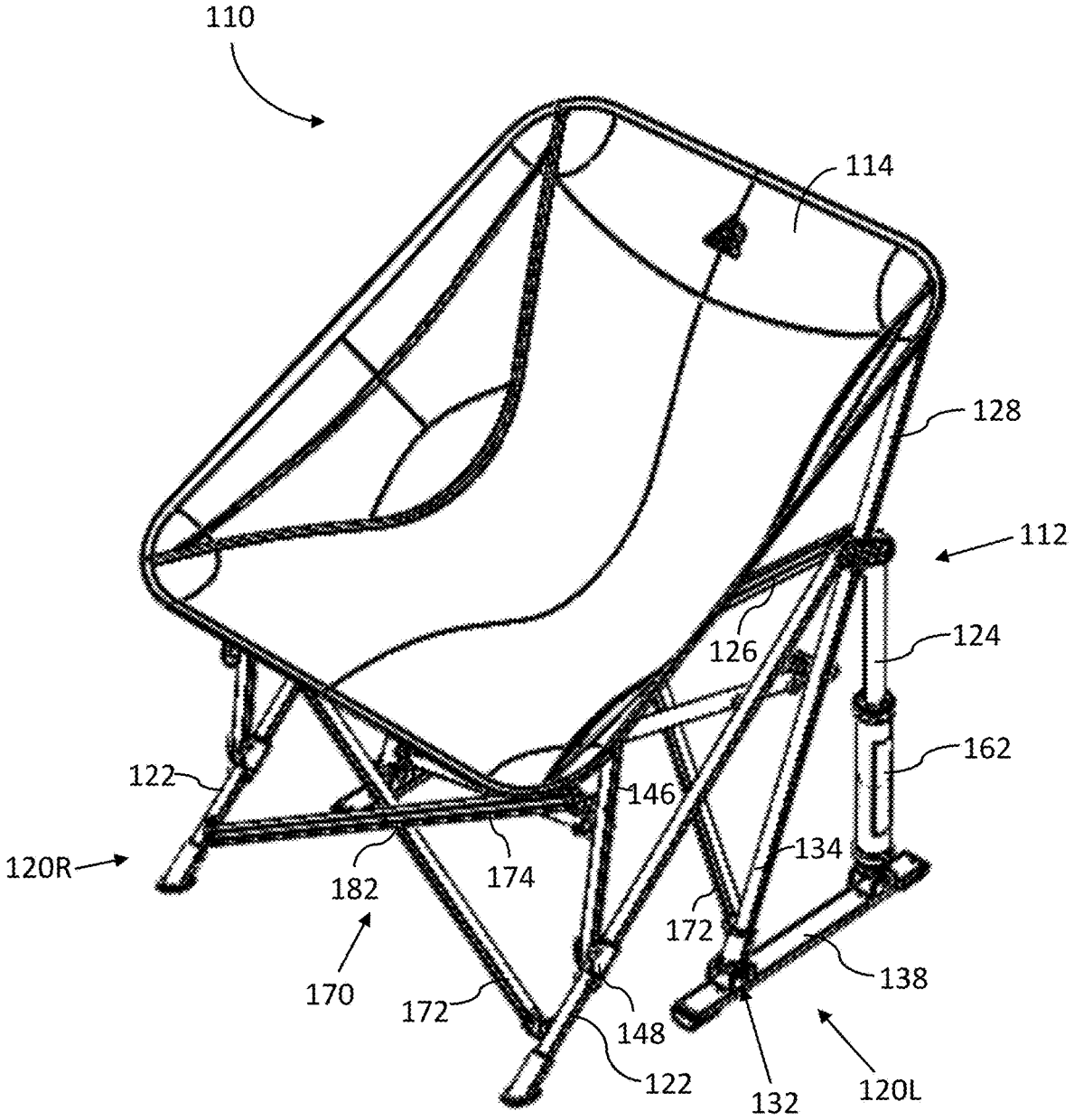
FIG. 11 is a perspective view of a collapsible and portable rocking chair in accordance with another embodiment of the present invention, with the rocking chair in a set-up condition, and with the rocking chair in a forward, stabilized position.

An alternative embodiment of a collapsible and portable rocking chair in accordance with the present invention is illustrated in FIG. 11 and generally designated by reference numeral 110. The chair 110 includes many of the same frame members as in the embodiment shown in FIG. 2. Accordingly, like members share similar reference designations for consistency.

As illustrated in FIG. 11, collapsible and portable rocking chair 110 comprise a chair frame 112 that includes left and right frame side assemblies 120L and 120R collectively defining front leg members 122, rear leg members 124, and back support members 128 for supporting a seating panel 114. Additional seat support members extend from the back support members 128 and the front leg members 122 in the set-up condition of the chair 110 to aide in supporting the front corners of the seating panel 114. More particularly, a first seat support member 126 extends forwardly from the back support member 128, while a generally vertically extending seat support member 146 extends from a sliding sleeve 148 mounted on the front leg member 122. The upper terminal ends of the back support members 128, as shown, support the upper/back corners of the seating panel 114.

The chair 110 also includes transverse connector assemblies 170 connecting the left and right frame said assemblies 120L and 120R and transversely supporting the frame 112 in the set-up condition of the chair 110. Pairs of connectors 172 and 174 are pivotally connected to one another as well as to the left and right frame side assemblies 120L and 120R to facilitate folding of the chair frame 112 to a collapsed condition, much in the same manner as described above with respect to chair 10. In a preferred design, the pairs of connectors 172 and 174 each comprise front and rear portions that are pivotally connected about respective central pivot points 182 to generally assume the shape of an X when the chair 110 is in the set-up condition and that are disposed in generally parallel relationship when the chair 110 is folded or collapsed for transportation and/or storage.

A rocker mechanism 162, as described above, is provided in connected with the rear leg member 124. Likewise, a fulcrum member 134, preferably integral with and extending down from the back support member 128, provides a fulcrum point 132 on and about which the chair 110 can rock. The lower ends of the rear leg member 124 and the fulcrum member 134 are pivotally connected to a static runner 138.

As illustrated, the seating panel 114 preferably has a one-piece bucket design supported at its four corners by the chair frame 112. This chair frame design provides a chair that does not need armrests.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A collapsible and portable rocking chair comprising:

an articulated chair frame defining a back support and a seat support, wherein said chair frame has a set-up condition and a collapsed condition;

a seat panel mounted on the seat support of the chair frame;

a backrest panel mounted on the back support of the chair frame;

wherein said chair frame comprises a pair of frame side assemblies of opposite hand disposed in generally parallelly extending and transversely spaced apart opposing relation to each other, each said frame side assembly having a plurality of generally axially elongated frame members being interconnected for pivotal movement relative to one another about generally transversely extending pivot axes, said frame members including:

a seat support member defining a respective side of the seat support; and a back support member defining a respective side of the back support and defining a fulcrum point at a terminal end thereof and about which said chair frame can move between forward and rearward positions;

at least one rocker mechanism attached to the chair frame for supporting the chair during movement of the chair frame between said forward and rearward positions; and at least one transversely extending connector assembly comprising connector members pivotally connected to each other about a pivot axis and pivotally connected to each of the frame side assemblies, said connector assembly aiding movement of the chair frame between the set-up and collapsed conditions;

wherein when the chair frame moves between the set-up and collapsed conditions, the frame members of said chair frame move relative to each other in both transverse and lengthwise directions.

2. The collapsible and portable rocking chair according to claim 1, wherein the frame members for each frame side assembly include a front leg member and a rear leg member;

wherein said rocker mechanism is attached to at least one of the front leg member and the rear leg member of each frame side assembly.

3. The collapsible and portable rocking chair according to claim 2, wherein the rocker mechanism comprises a sleeve associated with at least one of the front leg member and the rear leg member, said sleeve further housing a spring to which said leg member is connected.

4. The collapsible and portable rocking chair according to claim 1, further comprising a runner adapted to rest on the support surface upon which the chair sits when the chair is in the set-up condition and to which the back support member and the rocker mechanism are pivotally connected.

5. The collapsible and portable rocking chair according to claim 1, wherein each frame side assembly further comprises an armrest.

6. The collapsible and portable rocking chair according to claim 5, wherein, for each frame side assembly, the armrest is connected to the back support member.

7. The collapsible and portable rocking chair according to claim 6, wherein the armrest is adjustable for reclining movement of the back support member.

8. The collapsible and portable rocking chair according to claim 5, wherein each frame side assembly further includes an armrest support member pivotally connected to the armrest at a forward portion of said armrest and generally upwardly extending to support the armrest when the chair frame is in the set-up condition.

9. The collapsible and portable rocking chair according to claim 8, wherein the armrest is adjustable for reclining movement of the back support member by adjusting the position of the forward portion of said armrest relative to the armrest support member.

10. The collapsible and portable rocking chair according to claim 8, wherein the armrest support member is pivotally connected to a sleeve mounted on the front leg member, said sleeve being adapted for sliding movement on one of the axially elongated frame members when the chair frame is moved between the set-up and collapsed conditions.

11. The collapsible and portable rocking chair according to claim 1, wherein the seat panel and the backrest panel are connected together.

12. A collapsible and portable rocking chair comprising:

an articulated chair frame having a set-up condition and a collapsed condition;

wherein said chair frame comprises a pair of frame side assemblies of opposite hand disposed in generally parallelly extending and transversely spaced apart opposing relation to each other, each said frame side assembly having a plurality of generally axially elongated frame members being interconnected for pivotal movement relative to one another about generally transversely extending pivot axes, said frame members including:

a back support member;

a fulcrum member defining a fulcrum point at a terminal end thereof and about which said chair frame can move between forward and rearward positions; and a seat support assembly comprising a first seat support member extending forwardly from one of the back support member and the fulcrum member when the chair frame is in the set-up condition, and a second seat support member extending upwardly at a forward portion of the chair frame when the chair frame is in the set-up condition, the forward end of the first seat support member and the upper end of the second seat support member being pivotally connected together;

at least one rocker mechanism attached to the chair frame for supporting the chair during movement of the chair frame between said forward and rearward positions;

at least one transversely extending connector assembly comprising connector members pivotally connected to each other about a pivot axis and pivotally connected to each of the frame side assemblies, said connector assembly aiding movement of the chair frame between the set-up and collapsed conditions; and a seating panel mounted on the chair frame;

wherein when the chair frame moves between the set-up and collapsed conditions, the frame members move relative to each other in both transverse and lengthwise directions.

13. The collapsible and portable rocking chair according to claim 12, wherein the frame members for each frame side assembly include a front leg member and a rear leg member;

wherein said rocker mechanism is attached to at least one of the front leg member and the rear leg member of each frame side assembly.

14. The collapsible and portable rocking chair according to claim 13, wherein the rocker mechanism comprises a sleeve associated with at least one of the front leg member and the rear leg member, said sleeve further housing a spring to which said leg member is connected.

15. The collapsible and portable rocking chair according to claim 12, further comprising a runner adapted to rest on the support surface on which the chair sits when the chair is in the set-up condition and to which the fulcrum member and the rocker mechanism are pivotally connected.

16. The collapsible and portable rocking chair according to claim 12, wherein the back support member is integral with the fulcrum member.

17. The collapsible and portable rocking chair according to claim 12, wherein the second seat support member is pivotally connected to a sleeve mounted on the front leg member, said sleeve being adapted for sliding movement on said front leg member when the chair frame is moved between the set-up and collapsed conditions.

18. The collapsible and portable rocking chair according to claim 12, wherein the seating panel comprises four corners, each of which is mounted to the chair frame.

19. The collapsible and portable rocking chair according to claim 18, wherein the four corners of the seating panel comprise two rearward corners mounted to respective upper terminal ends of the back support members and two forward corners mounted to respective forward terminal ends of the first seat support members.

20. The collapsible and portable rocking chair according to claim 12, wherein the seating panel defines a bucket seat.

21. A collapsible and portable rocking chair comprising:

an articulated chair frame defining a back support and a seat support, wherein said chair frame has a set-up condition and a collapsed condition;

a seat panel mounted on the seat support of the chair frame;

a backrest panel mounted on the back support of the chair frame;

wherein said chair frame comprises a pair of frame side assemblies of opposite hand disposed in generally parallelly extending and transversely spaced apart opposing relation to each other, each said frame side assembly having a plurality of generally axially elongated frame members being interconnected for pivotal movement relative to one another about generally transversely extending pivot axes, said frame members including a back support member defining a respective side of the back support and defining a fulcrum point at a terminal end thereof and about which said chair frame can move between forward and rearward positions;

at least one rocker mechanism attached to the chair frame for supporting the chair during movement of the chair frame between said forward and rearward positions; and at least one transversely extending connector assembly aiding movement of the chair frame between the set-up and collapsed conditions;

wherein when the chair frame moves between the set-up and collapsed conditions, the frame members of said chair frame move relative to each other in both transverse and lengthwise directions.

* * * * *